US007448703B2

(12) United States Patent
Küng

(10) Patent No.: US 7,448,703 B2
(45) Date of Patent: Nov. 11, 2008

(54) RETAINING AND ADJUSTMENT DEVICE FOR MOVABLE FURNITURE PARTS

(75) Inventor: David Küng, Egg (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/783,700

(22) Filed: Apr. 11, 2007

(65) Prior Publication Data

US 2007/0209157 A1 Sep. 13, 2007

Related U.S. Application Data

(63) Continuation of application No. PCT/AT2005/000352, filed on Sep. 2, 2005.

(30) Foreign Application Priority Data

Oct. 12, 2004 (AT) ..... A 1699/2004

(51) Int. Cl.
*A47B 88/00* (2006.01)

(52) U.S. Cl. ..... 312/327; 312/325; 312/319.2; 162/286

(58) Field of Classification Search ..... 312/325, 312/327, 328, 116, 139, 138.1, 319.2, 319.3; 16/286; 49/246, 248; 160/213
See application file for complete search history.

(56) References Cited

U.S. PATENT DOCUMENTS

| | | | | |
|---|---|---|---|---|
| 2,393,052 | A * | 1/1946 | Mehard | 160/189 |
| 4,348,069 | A | 9/1982 | Lindsay et al. | |
| 5,904,411 | A * | 5/1999 | Hayakawa | 312/319.2 |
| 6,332,660 | B1 * | 12/2001 | Salice | 312/328 |
| 6,695,390 | B2 * | 2/2004 | Bucco Morello | 296/186.4 |
| 6,877,830 | B2 * | 4/2005 | Salice | 312/327 |
| 7,168,477 | B2 * | 1/2007 | Salice | 160/213 |
| 2002/0108311 | A1 * | 8/2002 | Salice | 49/371 |
| 2006/0174444 | A1 * | 8/2006 | Giovannetti | 16/354 |
| 2006/0284530 | A1 * | 12/2006 | Hollenstein | 312/327 |

FOREIGN PATENT DOCUMENTS

| | | |
|---|---|---|
| EP | 1 296 011 | 3/2003 |

* cited by examiner

*Primary Examiner*—Janet M Wilkens
(74) *Attorney, Agent, or Firm*—Wenderoth, Lind & Ponack, L.L.P.

(57) ABSTRACT

A retaining and adjusting device is provided for displaceable furniture parts, in particular for a leaf that is hinged so that it can pivot horizontally on an item of furniture, e.g. for a leaf of an upper cupboard. The device includes at least one control lever, whose length can be adjusted and which can be hinged on the part, the length of the control level and/or the position of the bearing point of the control lever being adjustable when the furniture part is closed.

24 Claims, 18 Drawing Sheets

3
13
12
6
8
5
10
6'
14
10'
11
2
16

3
13
6
12
5
10
8
2
10'
14
11
6'

1
3
6
5
10
10'
8
12
9
26
6'
27
2
D3
25
D3
10
10'
28
27
26
6'
25

26
32
32'
C
C
B
B
27
29
33
33'
31
25
C-C
B-B
34
30

RETAINING AND ADJUSTMENT DEVICE FOR MOVABLE FURNITURE PARTS

This application is a continuation of International Application No. PCT/AT2005/000352, filed Sep. 2, 2005.

BACKGROUND OF THE INVENTION

The present invention relates to a retaining and adjustment device for movable furniture parts, in particular for a furniture flap horizontally pivotally connected to a furniture body, e.g. for a flap of an overhead cabinet, which includes at least one actuating arm which can be coupled to the furniture part and which is length-adjustable. The invention further relates to a piece of furniture with a furniture body and a folding flap which includes a first partial flap, which is fixed about a horizontally disposed first axis to a cupboard cover of the furniture body, and a second partial flap, which is pivotably connected about a horizontally disposed second axis with the first partial flap.

Furthermore the present invention relates to a method for adjustment of a length-adjustable actuating arm and a further method for setting the bearing point position of an actuating arm connected to a movable furniture part.

To move movable furniture parts, in particular furniture flaps of the aforementioned type, so-called cover positioning devices are used, which include an actuating arm to pivot the furniture flap from a closed into an open position. Usually, the cover positioning device has a core which is fixed to a side wall of the furniture body, while the actuation arm projecting out of the core is movably connected to the furniture flap or to a partial flap thereof. As the sizes of the furniture body and/or the furniture flaps vary, there is also variation in the length of the adjustment lever arm required to move the movable furniture part from the completely closed position into the completely open position. Hence length-adjustable actuation arms have already become known in the art, in order to adapt flaps of varying size to various body sizes. In the solutions known in the state of the art, however, the adjustment process has proved to be excessively complicated and time-consuming, since the length-adjustable actuation arm, on installation, is firstly adjusted approximately in its length and, by multiple opening and closing of the furniture flap, is successively adjusted to the requisite length. This is very time-consuming and optimum adjustment is often only achieved by trained specialist personnel.

SUMMARY OF THE INVENTION

It is therefore an object of the present invention to provide a retaining and adjustment device of the aforementioned type which is characterised, apart from extremely simple operation, by high precision with respect to optimum length adaptation of the actuation arm.

This is achieved according to the invention by the fact that the length of the actuation arm and/or the bearing point position of the actuation arm can be adjusted when the furniture part is closed.

The adjustment of the actuation arm according to the present invention can be done without the use of tools, since an automatic adjustment occurs which is triggered by a movement of the furniture part initiated by the user—preferably during the closing movement of the furniture flap. This eliminates multiple readjustment and the associated repetitive opening and closing of the furniture flap. When the furniture flap is in closed condition, the actuation arm is in a "default setting" in which it is pre-fixed.

Advantageously, provision is made that the actuation arm has at least two actuation arm parts which slide into each other. The execution can then be such that at least two actuation arm parts frictionally engage with each other in order to pre-fix the adjusted length of the actuating arm. Although the actuating arm can alter its length due to the frictional engagement, when reaching the default position it adopts its adjusted position.

In construction terms, provision may advantageously be made that the frictional engagement is preferably brought about by a spring-loaded pressure element, which is pressed onto the inner wall of the actuation arm. The spring-loaded pressure element can, for example, be made from plastic with high friction coefficients. As an alternative, in principle all frictional engagement connections known in the state of the art may be used.

If the length of the actuation arm is set on reaching the final closed position of the flap, access to the actuation arm can be restored by opening the flap, in which case it is advantageous for the length of the actuating arm to be finally fixable by a stop device. It can then be advantageous if the stop device has a tension lever to enable rapid fixation.

As an alternative or addition to the actuation arm described above, another refinement of the invention is characterised in that the bearing point position of the actuating arm can be fixed by a fixation device arranged on the movable furniture part, whereby an actuation member of the fixation device can be actuated from the outside when the furniture part is closed. This means that the bearing location of the attached actuating arm on the furniture flap can be varied and also prefixed.

The inventive piece of furniture is characterised in that it has a furniture body and a folding flap, whereby the folding flap comprises a first partial flap which is fixed about a horizontally disposed first axis on a cupboard cover of the furniture body and at least one second partial flap, which is pivotably connected about a horizontally disposed second axis with the first partial flap, wherein there is provided a retaining and adjustment device according to the type described in this specification.

The inventive method of adjustment of a length-adjustable actuation arm is characterised by the following steps:

- The actuation arm is pivotably fixed about a first axis on the furniture body and pivotably fixed about a second axis on the movable furniture part,
- The movable furniture part is brought into the closed position, whereby the length of the actuation arm is altered,
- The movable furniture part is opened again,
- The length-adjustable actuation arm is finally fixed in the length set with the furniture part closed.

The inventive method of setting the bearing point position of an actuation arm connected to a movable furniture part is characterised by the following steps:

- The actuation arm is pivotably fixed about a first axis on the furniture body and pivotably fixed about a second axis on the movable furniture part,
- The movable furniture part is brought into the closed position, whereby the bearing point position of the actuation arm on the movable furniture part is altered,
- The movable furniture part is opened again,
- The bearing point position of the actuation arm set with the furniture part closed is finally fixed.

Further details and advantages of the present invention will be explained in more detail with the aid of the description of the figures, making reference to the drawings, which show:

DETAILED DESCRIPTION OF THE INVENTION

Figure 1:
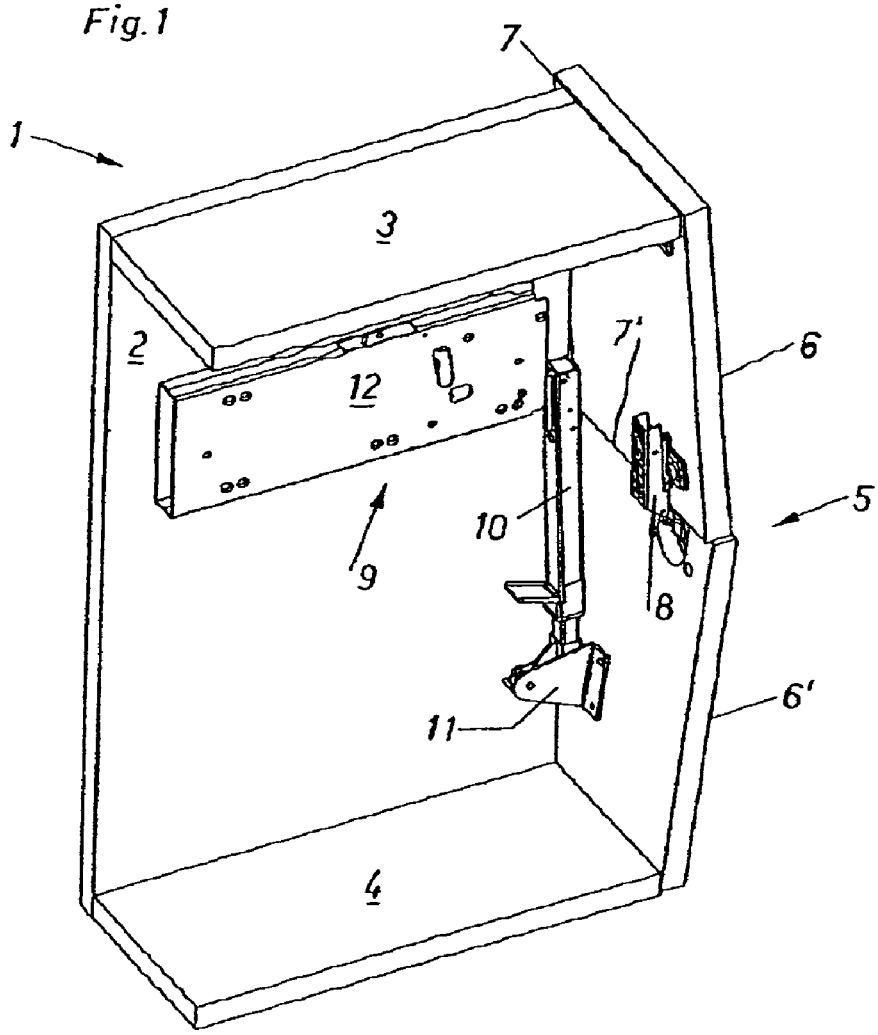
FIG. 1A perspectival exemplary sectional view through a piece of furniture with the retaining and adjustment device according to the invention.

FIG. 1 shows a perspectival sectional view through a piece of furniture 1 which has side walls 2, a cupboard cover 3 and a drawer base 4. A movable furniture part 5 comprises a folding flap with two partial flaps 6, 6', where the first partial flap 6 is fixed about a horizontally disposed first axis 7. The second partial flap 6' is pivotably connected about a horizontally disposed second axis 7' with the first partial flap 6. A hinge fitting 8 with two- or three-dimensional adjustment can be provided for the reciprocal connection of the two partial flaps 6, 6'. A cover positioning device 9 is fixed to the vertical side wall 2. The device 9 comprises a core 12 and an actuating arm 10 pivotably connected thereon. No further details of the core 12 will be provided in the course of the present invention, since this is not essential to the invention. It should be noted that this core 12 can in principle have all devices known according to the state of the art. The core 12 can be constructed to such a design that it impacts a force upon the actuating arm 10 with a turning moment such that the furniture flap 5 is retained in each pivoted position relative to the furniture body. The actuating arm 10 is fixed so as to be pivotable in the way known in the art about a first axis on the core 12 and pivotable about a second axis on the furniture flap 5—in the present case, on the lower partial flap 6'—via a fixing element 11.

Figure 2:
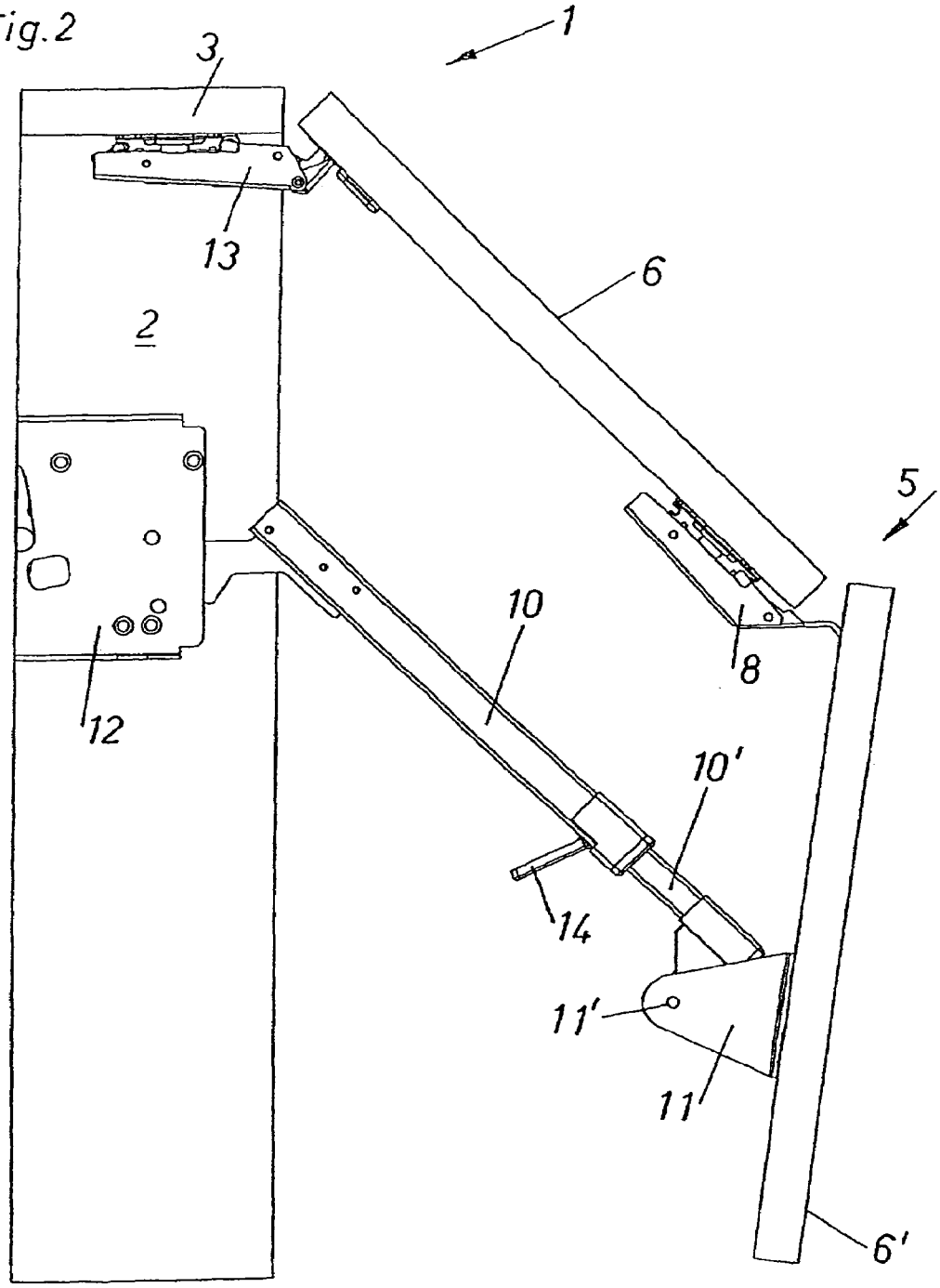
FIG. 2 A lateral view of the furniture from FIG. 1 at the start of the adjustment process of the actuating arm.

FIG. 2 shows a lateral view of the inner area of the side wall 2 of the piece of furniture 1. The upper partial flap 6 of the furniture flap 5 is connected with the underside of the cupboard cover 3 by means of an adjustable hinge 13. The cover positioning device 9 comprises a core 12 fixed to the side wall 2, to which the length-adjustable actuating arm 10 is pivotably connected. As the sizes of the furniture body and/or the furniture flaps 6, 6' vary, the requisite length of the actuating arm 10 must also be varied, in order to move the furniture flap 5 with its partial flaps 6, 6' into its completely closed position, so that the partial flaps 6, 6' lie flat on the front side of the furniture body. The actuating arm 10 has at least one actuating arm part 10', which is pivotably connected via the axis 11' of the fixing element 11 to the partial flap 6' and can be displaced relative to the actuating arm 10. Preferably, the actuating arm 10 and its actuating arm part 10' can be slid into each other in the manner of a telescope. The actuating arm parts 10, 10' are connected to prefix the adjusted length by frictional engagement and can be finally fixed in their position relative to each other by a tension lever 14 of a stop device 15 which is yet to be described.

Figure 3:
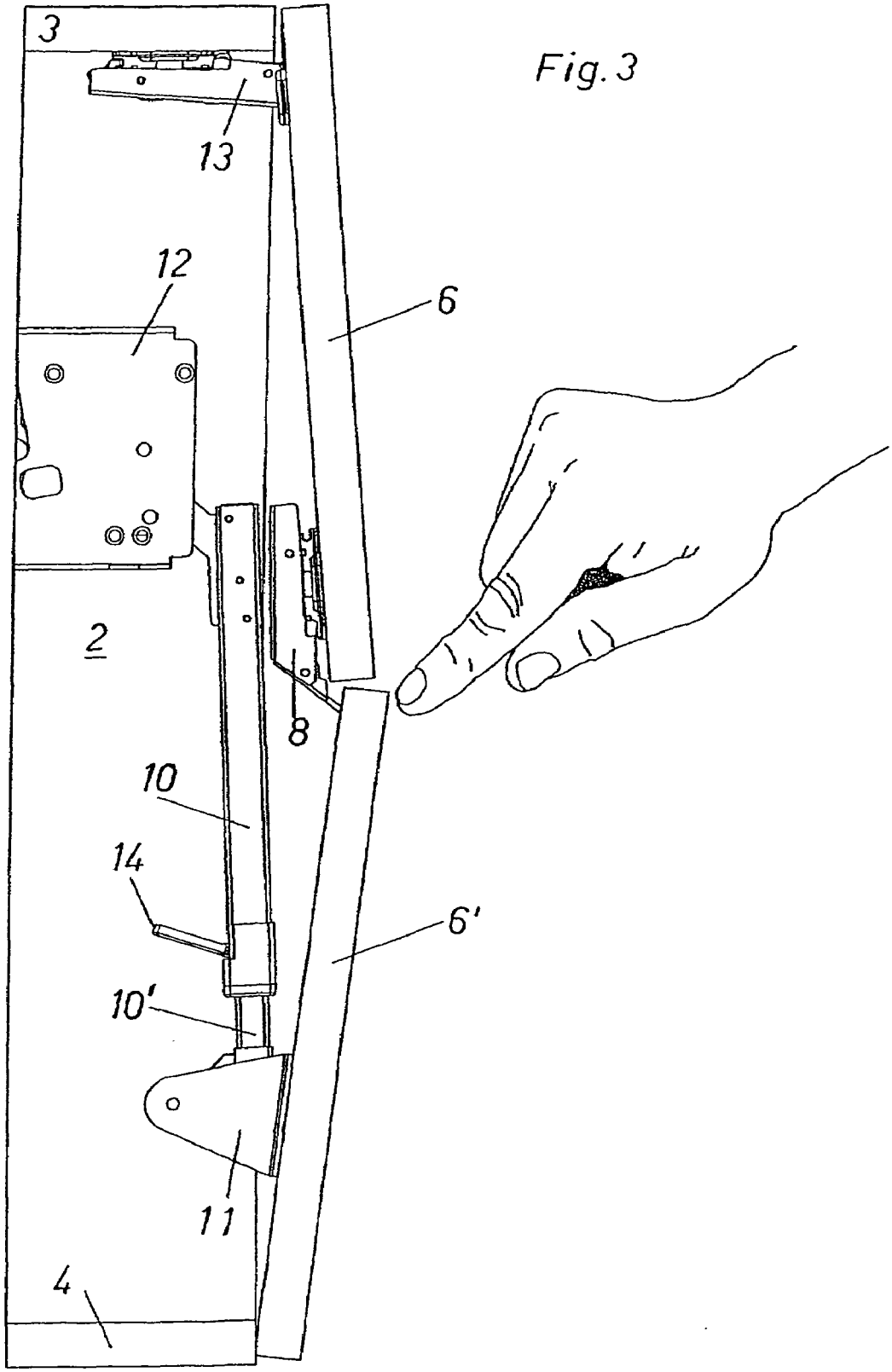
FIG. 3 A lateral view of the furniture in a further phase of the adjustment process of the actuating arm.

FIG. 3 shows the position of the two partial flaps 6, 6' and the actuating arm 10 with its telescoping actuating arm part 10' in a further phase of the adjustment process. In the view shown, the length of the actuating arm 10, 10' is too short, so that the two partial flaps 6, 6' cannot be brought into the intended closed position so that they lie flat on the front face of the furniture body. The partial flaps 6, 6' can be brought into their closed position by manual pressure on the area of the hinge fitting 8, whereby the length of the actuating arm 10, 10' is altered. This is possible due to the frictional connection of the actuating arm 10 with its actuating arm part 10'. Preferably, provision is made that the actuating arm 10, 10' is in a substantially retracted position at the start of the adjustment process.

Figure 4:
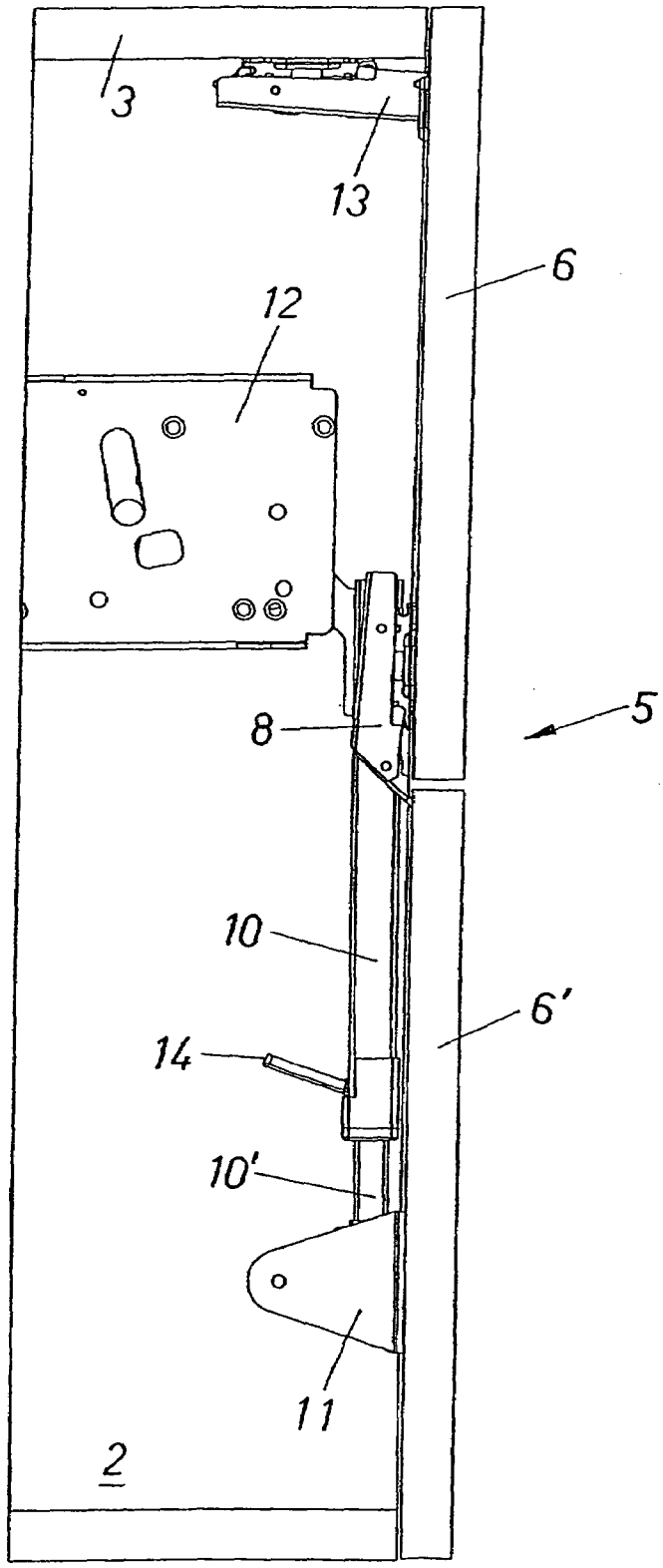
FIG. 4 A lateral view of the furniture with parallel partial flaps.

FIG. 4 shows a lateral view of the piece of furniture 1 in the next phase of the adjustment process. Both partial flaps 6, 6' of the furniture flap 5 have already been brought into their closed position, the actuating arm 10 and its actuating arm part 10' having changed in their position relative to each other, in this case becoming longer. Both partial flaps 6, 6' essentially lie flat on the front of the furniture body.

Figure 5:
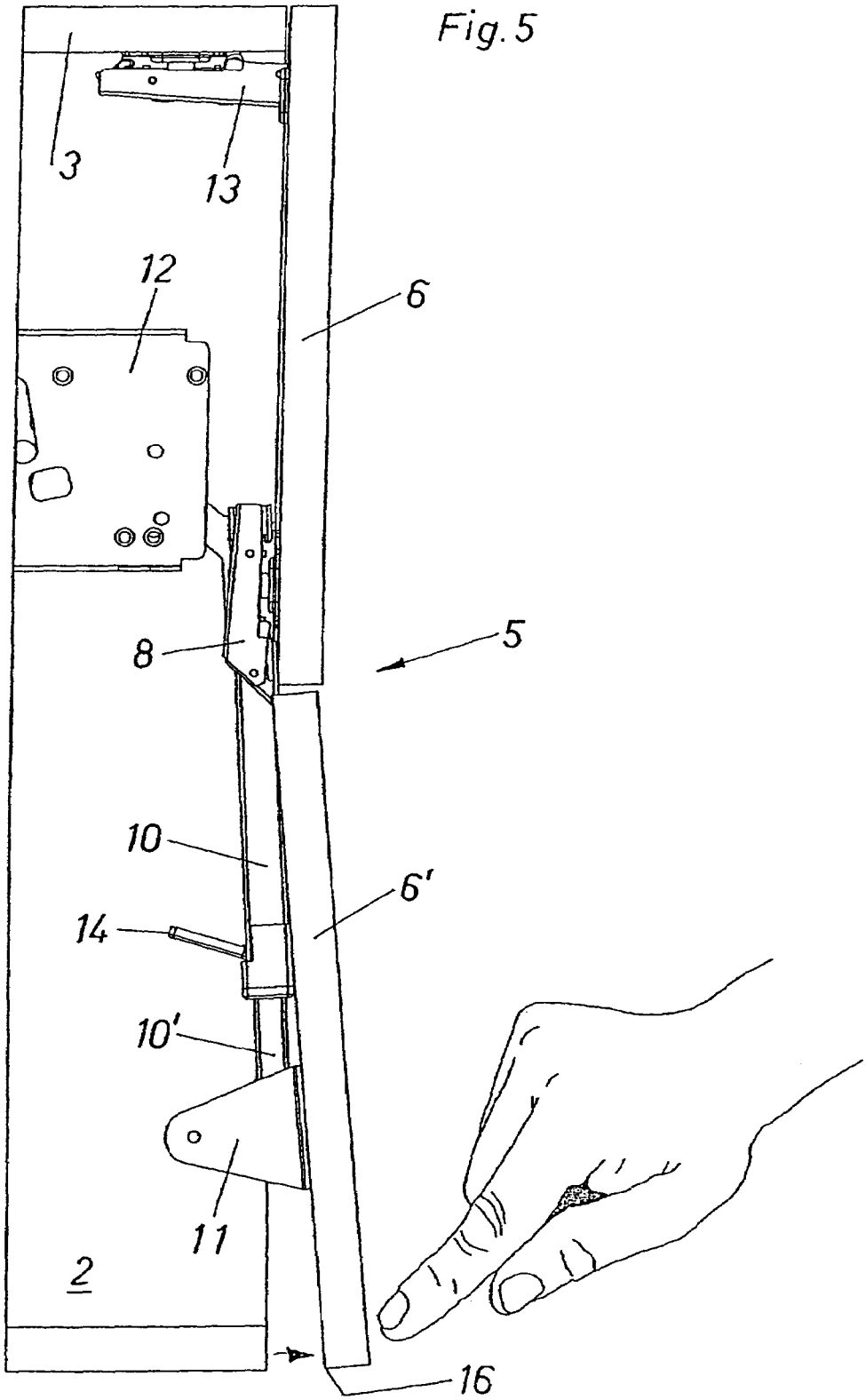
FIG. 5 A lateral view of the furniture with the actuating arm being too short.

FIG. 5 shows a lateral view of the furniture with the actuating arm 10, 10' being too long. When the actuating arm 10, 10' is too short or too long in the initial position, the two partial flaps 6, 6' are not yet arranged exactly parallel to the furniture body. The unadjusted position of the two partial flaps 6, 6' can also be due to the elastic behaviour of the whole system. In order to shorten the actuating arm 10, 10', the lower partial flap 6' in the area of its lower edge 16 is moved, counter to the direction of the arrow shown, towards the furniture body, while the area of the central pivot point in the proximity of the hinge fitting 8 is pulled outwards with the other hand, and thus moved slightly away from the furniture body again. This reduces the length of the actuating arm 10 with its actuating arm part 10' and the two partial flaps 6, 6' can be aligned exactly with the furniture body. The length of the actuating arm 10 for the purpose of intended movability of the furniture flap 5 has now adopted its requisite extent and is prefixed in its length by the frictional connection provided.

Should the length of the actuation arm 10, 10' be too short in the initial position, the furniture flap 5 would be somewhat arched in relation to the furniture body. In this case, the arched furniture flap 5 is pressed onto the furniture body from outside in the area of the hinge fitting 8, with the result that the actuating arm 10, 10' is lengthened. Both partial flaps 6, 6' can thus be adapted in parallel fashion to the furniture body.

Figure 6:
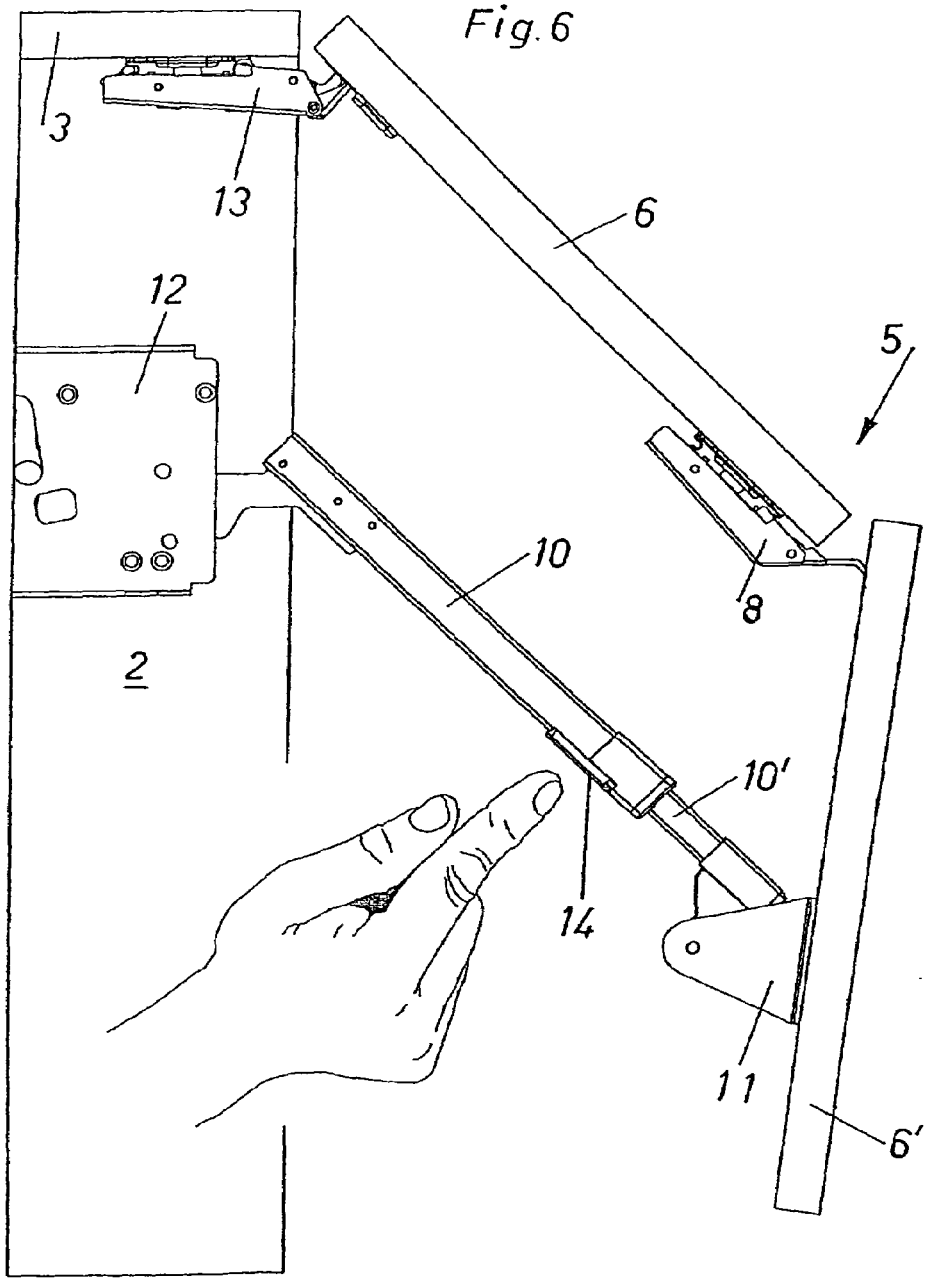
FIG. 6 A lateral view of the furniture with tension lever locked.

FIG. 6 shows the lateral view of the piece of furniture 1 in a subsequent phase of the adjustment process. The furniture flap 5 is—as shown—again brought into an open position, as the result of which the tension lever 14—which has previously always been in a relaxed position—becomes accessible. The tension lever 14 is part of a stop device 15, not shown, by which the length-adjustable actuating arm 10, 10' is finally fixed in the position which has been prefixed during closing of the furniture flap 5. The tension lever 14 ends substantially flush with the outer area of the actuating arm 10, 10', which can effectively prevent any unintentional opening of the tension lever 14.

Figure 7:
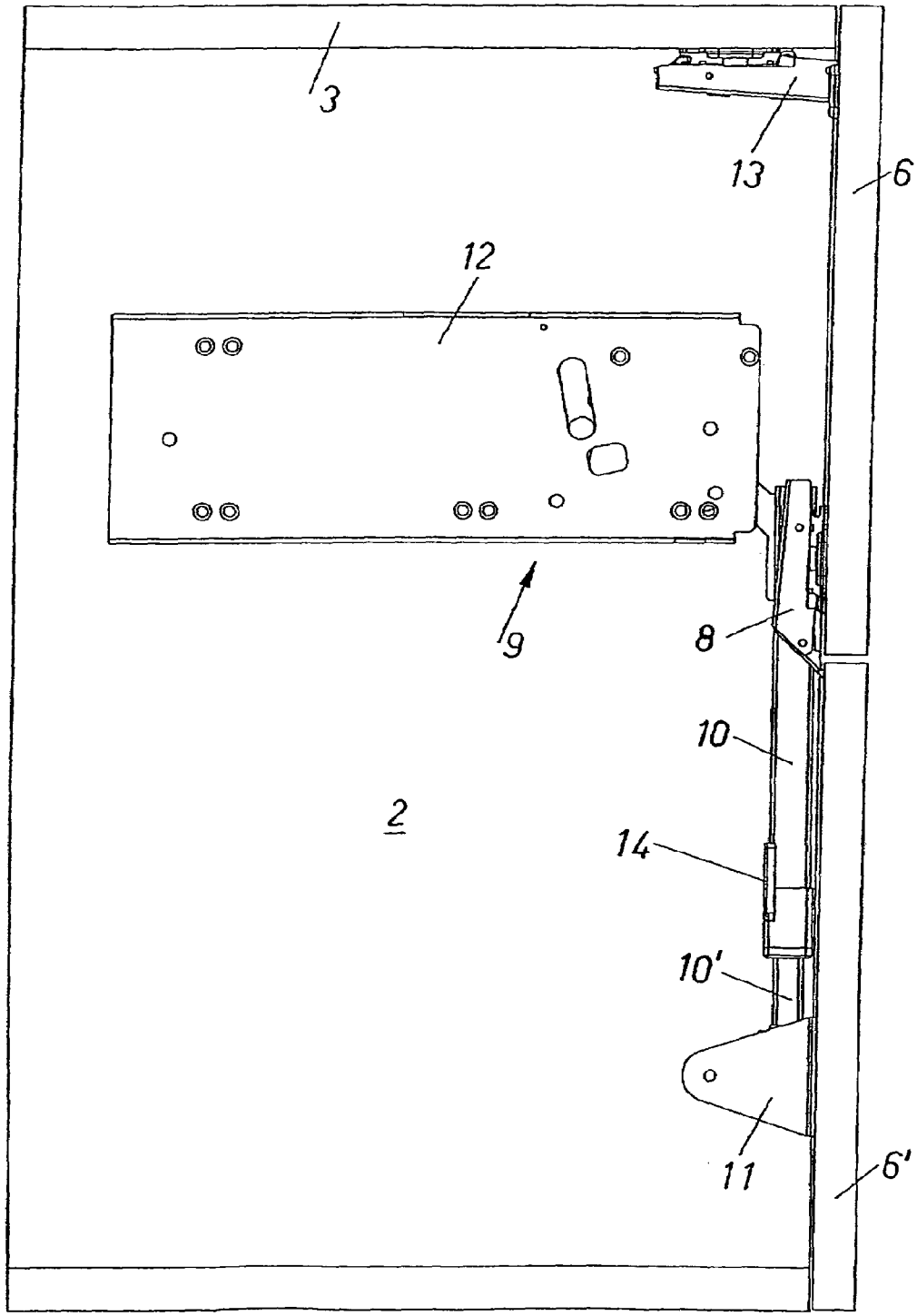
FIG. 7 A lateral view of the furniture in the closed position with finally fixed actuating arm.

FIG. 7 shows a lateral view of the furniture 1 with the two partial flaps 6, 6' in the closed position, where the actuating arm 10 has been finally fixed by the tension lever 14 as described in FIG. 6. The adjustment process up to the final fixation consists merely of a single closing and a single opening movement.

Figure 8A:
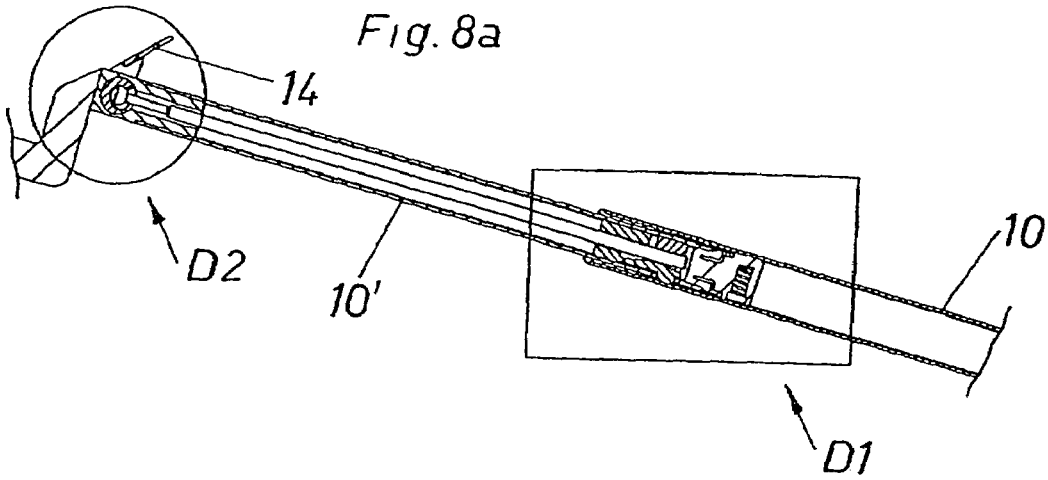
FIGS. 8*a*-8*c* An exemplary embodiment of a length-adjustable actuating arm with various detail views.
Figure 8B:
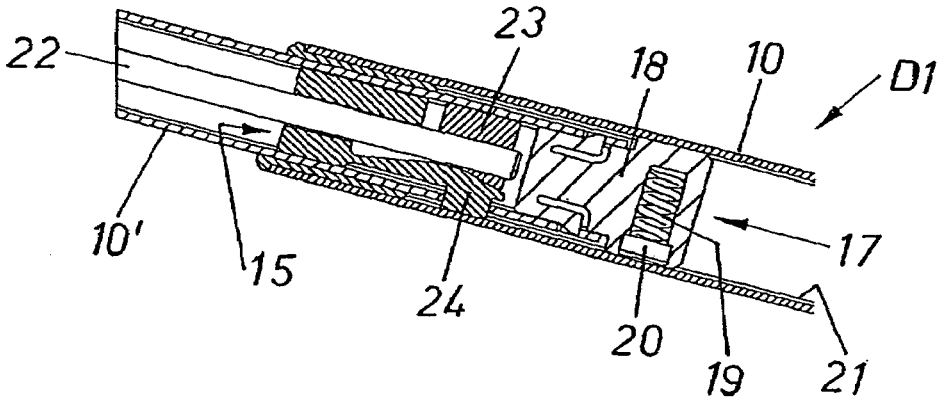
Figure 8C:
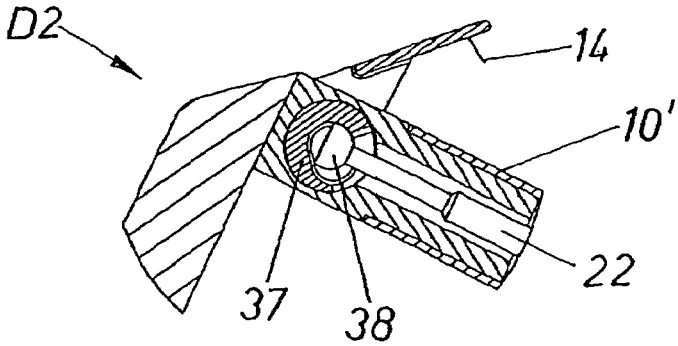

FIG. 8*a* shows an embodiment of a length-adjustable actuating arm 10, 10'. FIG. 8*b* and FIG. 8*c* respectively show the detail D1 and D2 from FIG. 8*a*. FIG. 8*a* shows the actuating arm 10 and its adjustable actuating arm part 10', which are held together by a frictional connection 17—as shown in FIG. 8*b*—against displacement relative to each other. The frictional connection 17 in the interior of the actuating arm 10 has a retaining part 18, while a spring element 19 in the form of a pressure spring is housed in a bore. Here the pressure part 20 acted on by the spring element 19 is constantly pressed against the inner side 21 of the actuating arm 10. So although both actuating arm parts 10, 10' can be moved if the frictional forces are overcome, these forces are nevertheless sufficient for a prefixation of the two actuating arm parts 10, 10'. For final fixation, a stop device 15 is provided, which includes an adjusting rod 22, on the end of which is moulded a wedge-shaped tension element 23. If the adjusting rod 22—as also shown in FIG. 8*b*—is moved to the left by actuation of the tension lever 14, pressure is exerted via the wedge-shaped area of the tension part 23 on the corresponding area of the clamping element 24, as the result of which the clamping element 24 is pressed onto the inner wall 21 of the actuating arm 10, thus enabling stable fixation of the two movable levers 10, 10'. FIG. 8*c* shows the detail D2 from FIG. 8*a*, where this side of the actuating arm part 10' is connected with the core 12 which can be fixed to the furniture body. By actuating the tension lever 14 towards the actuating arm part 10', an eccentric 37 is moved, in which a moulded-on head 38 of the adjusting rod 22 is supported. By moving the eccentric 37, the adjusting rod 22 is also moved via the head 38 and thus the wedge-shaped tension part 23—as described above under FIG. 8*b*—is moved.

Figure 9:
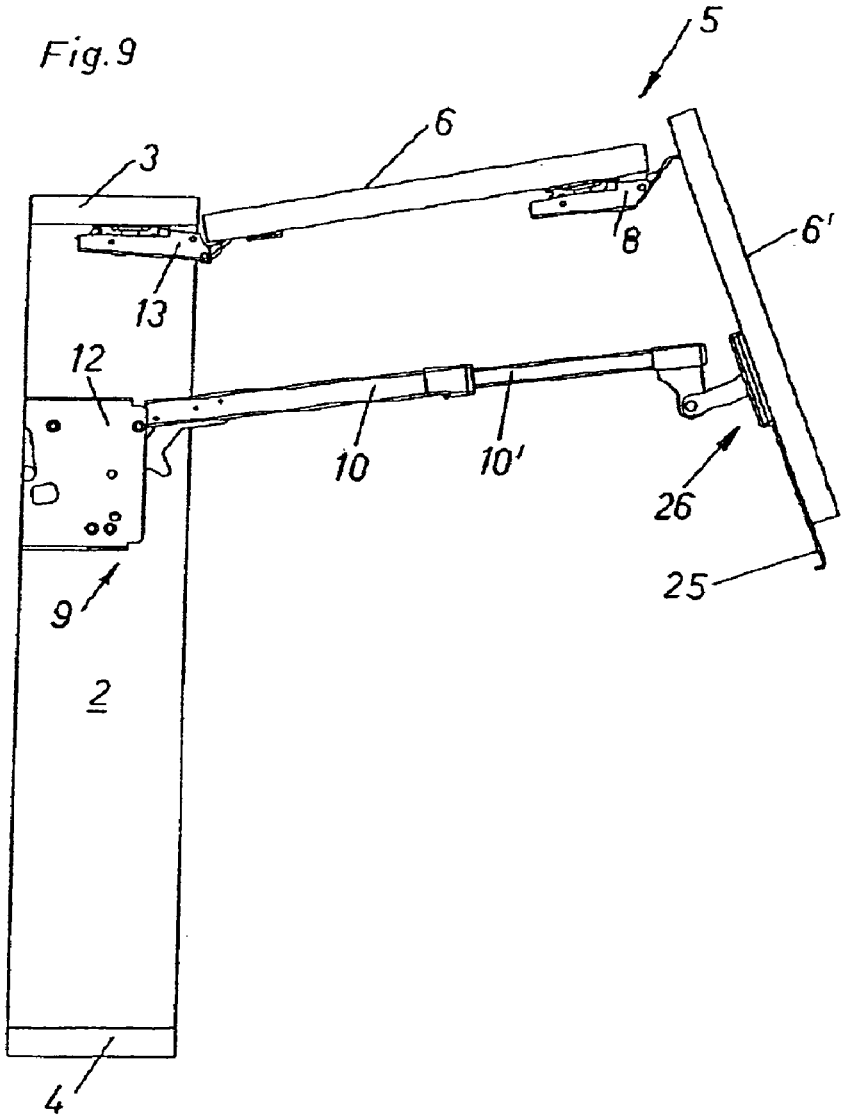
FIG. 9 A further embodiment of the invention with a fixing device to adjust the bearing point position of the actuating arm in the initial position.

FIG. 9 shows an advantageous refinement of the invention in which the bearing point position of the actuating arm 10, 10' is adjustable when the furniture part 5 is closed. The lateral view shown again shows a side wall 2 of the piece of furniture 1 with cupboard cover 3 and cabinet base 4. A movable furniture part 5 in the form of two partial flaps 6, 6' is attached to a hinge 13 fixed to the underside of the cupboard cover 3. The two partial flaps 6, 6' are connected to each other via a horizontal axis with an adjustable two- or three-dimensional hinge fitting 8. A core 12 of a cover positioning device 9 with which an actuating arm 10, 10' is rigidly connected, is fixed to the side wall 2. The actuating arm 10, 10' is connected to the lower partial flap 6', where the bearing point position of the actuating arm 10, 10' can be fixed by a fixing device 26 arranged on the lower partial flap 6', whereby an actuation member 25 of the fixing device 26 can be actuated from outside when the furniture part 5 is closed. This fixing device 26 provided at the bearing point position is preferably provided when the actuating arm 10 is not length-adjustable, but has a length already provided in the scope of delivery of the furniture according to the size of the flap. This adjustment of the bearing point position serves, in the present case, to equalise slight dimensional and production tolerances of the furniture system.

Figure 10:
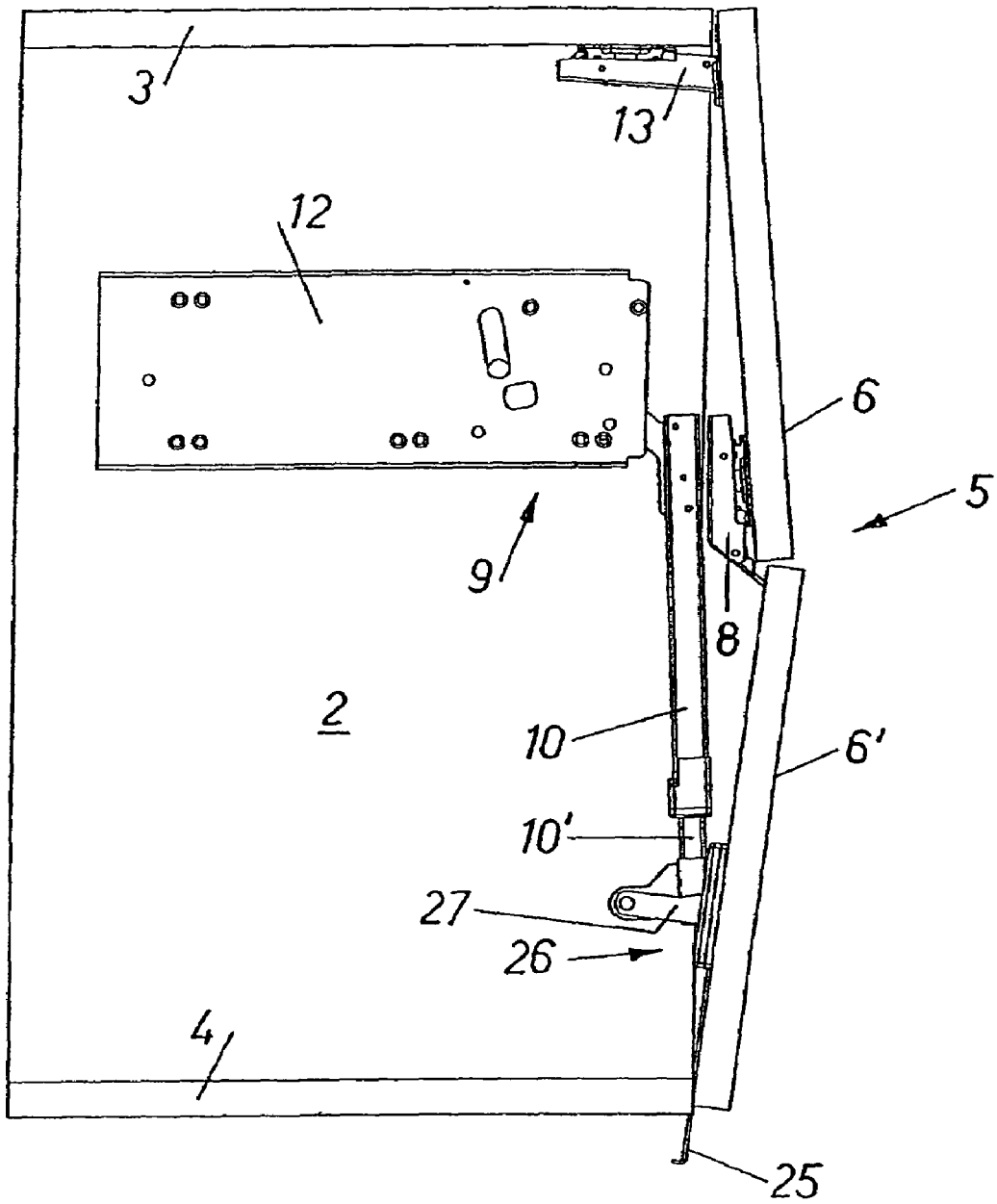
FIG. 10 A lateral view of the furniture with the bearing point position of the actuating arm being too low.

FIG. 10 shows a lateral view of the furniture 1 from FIG. 9 in a further step of the adjustment process for pre-fixation of the bearing point position of the actuating arm 10, 10'. In the view shown, the bearing point position of the actuating arm 10, 10' is set too low in relation to the lower partial flap 6', hence both partial flaps 6, 6' are unable to lie flat on the furniture body. The remedy for this is that the bearing part 27 is vertically adjustable within the fixing device 26 with respect to the partial flap 6', as long as the actuation member 25 is not in a clamping connection with the fixing device 26. The actuation member 25 protrudes beyond the lower edge of the cabinet base 4, so that this is actuatable even when the furniture flap 5 is closed. As in FIG. 3, when there is too short an actuating arm 10, 10', both partial flaps 6, 6' are moved in the direction of the closed position by pressure on the furniture flap 5 in the area of the hinge fitting 8, as the result of which, when the length of the adjustment lever arm 10, 10' cannot be adjusted, the bearing part 27 slides upwards in relation to the fixing device 26 and therefore to the partial flap 6'.

Figure 11:
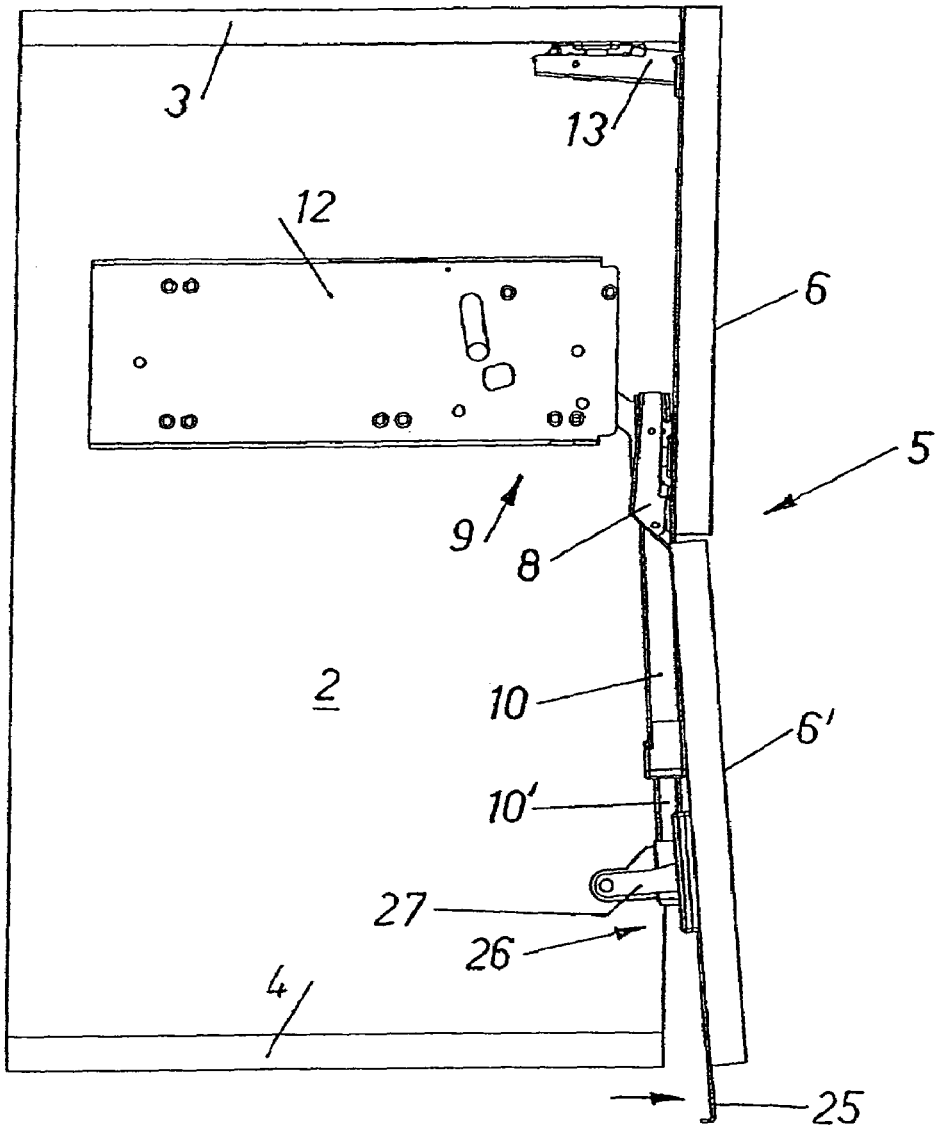
FIG. 11 The arrangement from FIGS. 9 and 10 with the bearing point position of the actuating arm being too high.

FIG. 11 shows a position of both partial flaps 6, 6' where the bearing point position of the actuating arm 10, 10' is set too high with respect to the lower partial flap 6'. As in FIG. 5, when there is too long an actuating arm 10, 10', the lower partial flap 6' in the area of the lower edge—in the present case on the actuation member 25—is moved towards the furniture body counter to the direction of the arrow shown, while at the same time the partial flaps 6, 6' are drawn slightly outwards with the other hand in the area of the hinge fitting 8, so that with an actuating arm 10, 10' which is invariable in length, the bearing part 27 slides downwards slightly in relation to the lower partial flap 6'.

Figure 12:
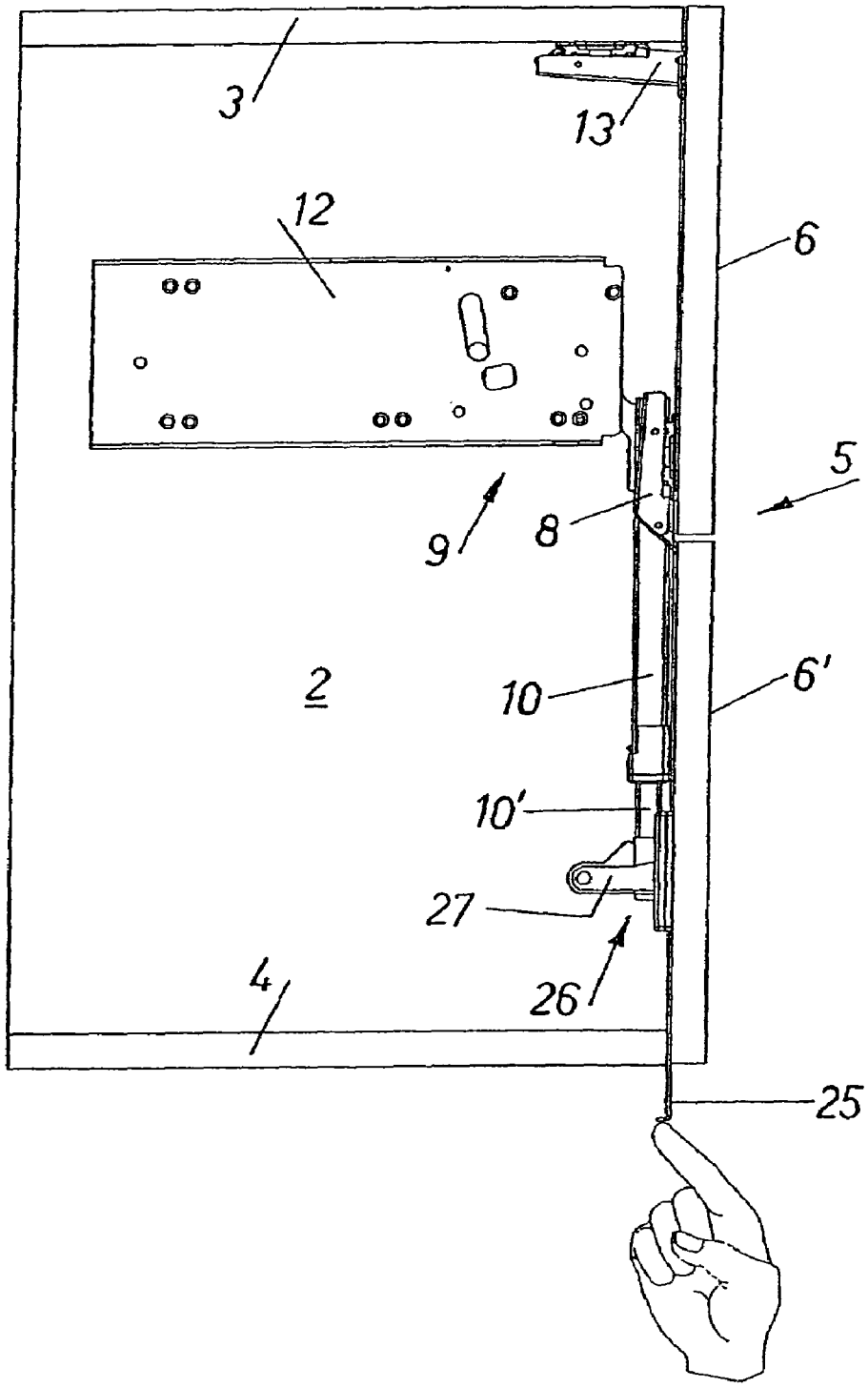
FIG. 12 The arrangement from FIGS. 9 to 11 with parallel partial flaps.

FIG. 12 shows the position of the partial flaps 6, 6' in a further phase of the adjustment process for prefixation of the bearing point position of the actuating arm 10, 10' in which the two partial flaps 6, 6' lie flat on the front of the furniture body. Now the actuation member 25 can—as indicated—be actuated with the furniture flap 5 closed, by being pushed vertically upwards.

Figure 13:
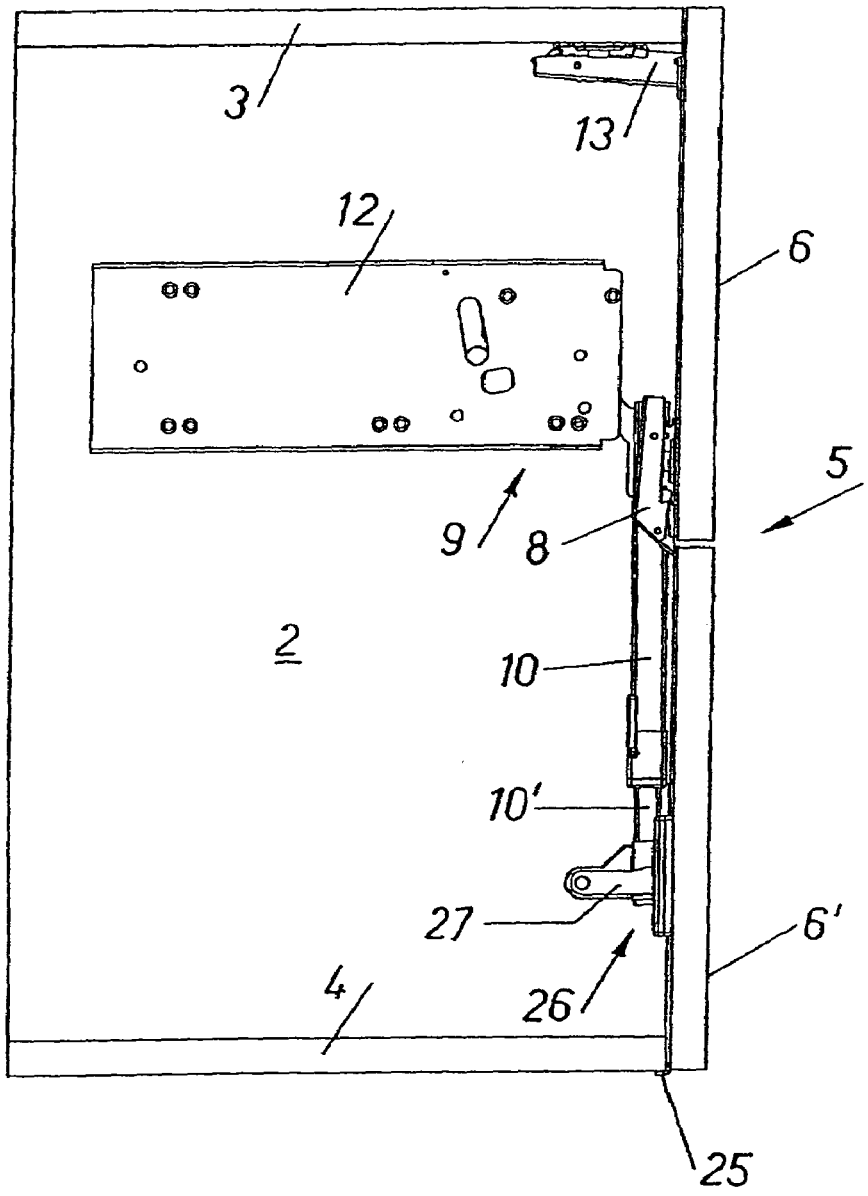
FIG. 13 A continuation of the adjustment process from FIG. 12 with prefixed actuation member.

FIG. 13 shows the continuation of the adjustment process of the bearing point position of the actuating arm 10, 10'. By pressing on the actuation member 25 of the fixing device 26, the bearing part 27 has been prefixed and thus is in a "default setting". The actuation member 25 substantially abuts on the lower edge of the cabinet base 4.

Figure 14:
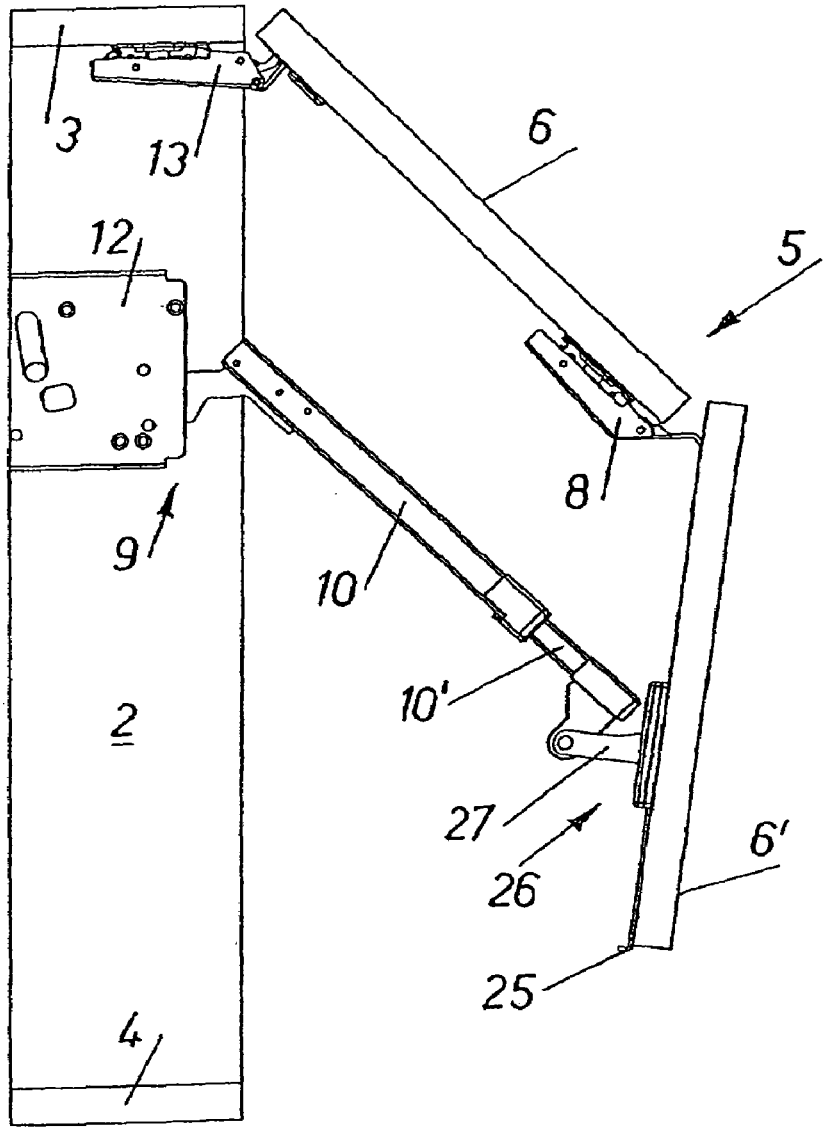
FIG. 14 A further phase of the adjustment process with finally fixed bearing point position of the actuating arm.

FIG. 14 shows a continuation of the adjustment process after the two partial flaps 6, 6' have again been brought into an open position. The final fixation of the bearing part 27 can now be made by the actuation member 25 by bringing this completely into its final position. The length of the actuating arm 10, 10' with the described adjustment of its bearing point enables an intended open and closed position of the flaps 6, 6'.

Figure 15:
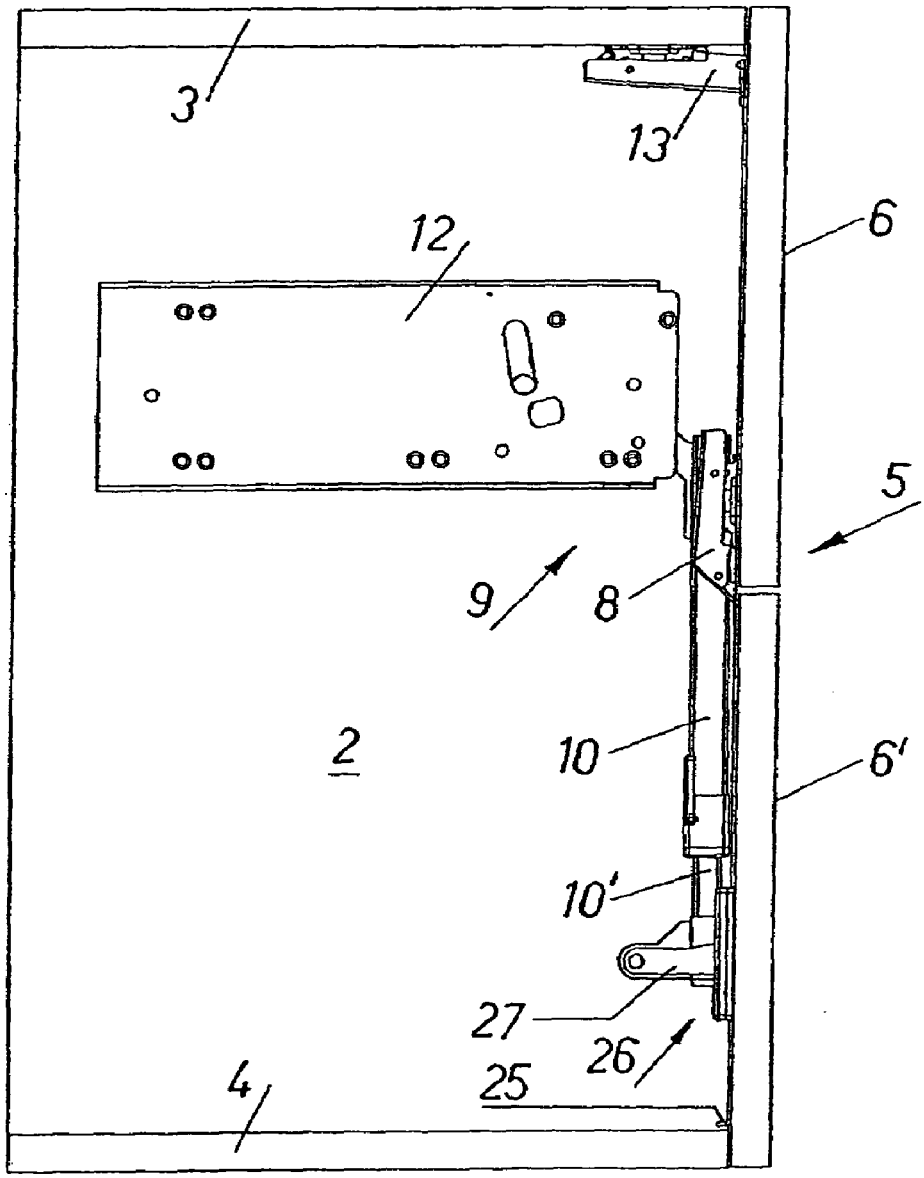
FIG. 15 The furniture with finally fixed bearing point position of the actuating arm with closed partial flaps.

FIG. 15 shows the closed position of the two partial flaps 6, 6' with fixed position of the bearing part 27, on which the actuating arm 10, 10' is pivotably connected. In the final fixation, the actuation member 25 of the fixing device 26 has been pushed so far into the fixing device 26 that it is no longer visible from the outside. This method of adjustment of the bearing point position of the actuating arm 10, 10' can either be used when the actuating arm 10, 10' cannot be adjusted in length or—if necessary—also when a length-adjustable actuating arm 10, 10' is used.

Figure 16:
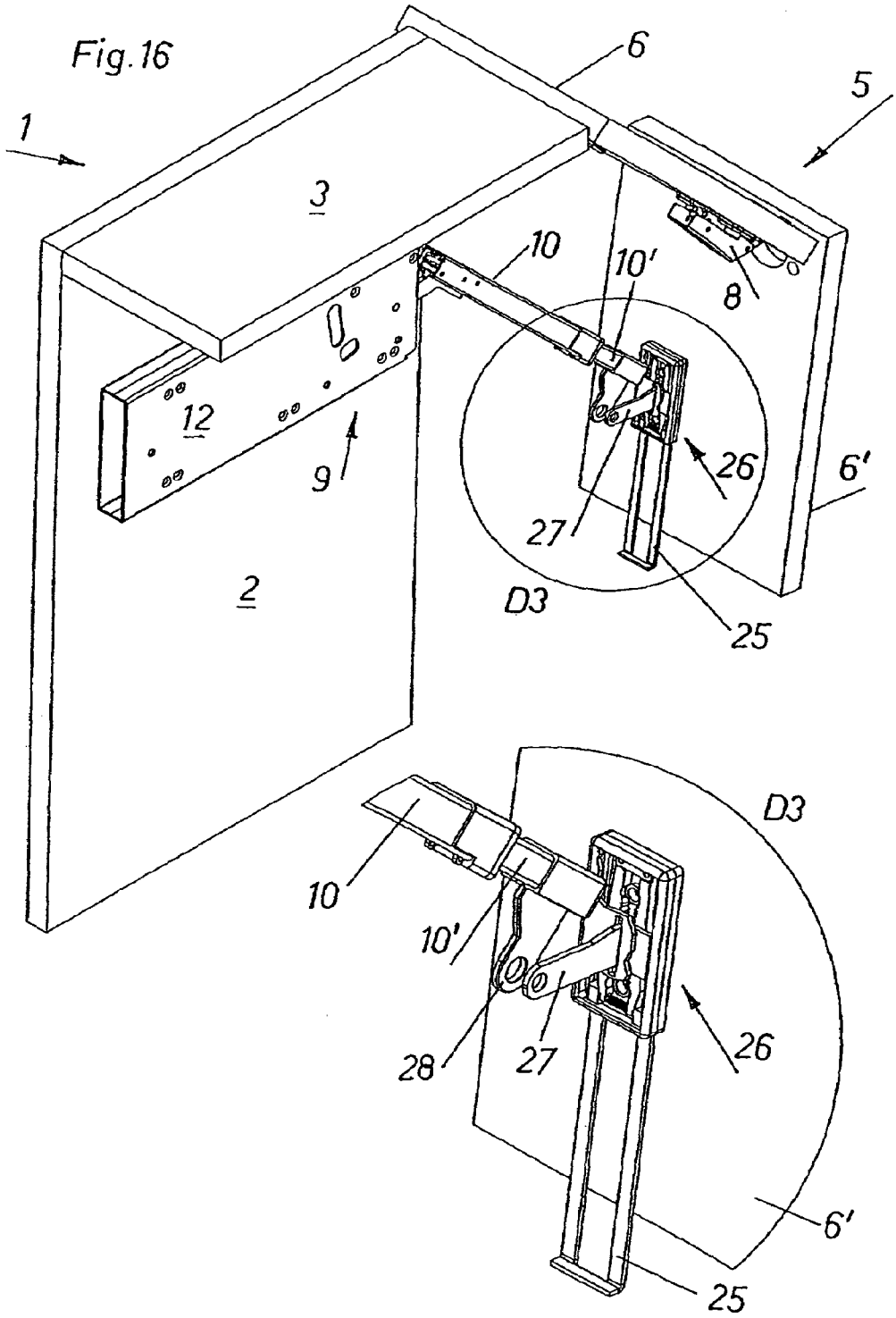
FIG. 16 A perspectival view of the furniture from FIGS. 9-15 with a detail view of the fixing device.

FIG. 16 shows a perspectival view of the furniture 1 from FIGS. 9 to 15 with a partly dismantled detail view D3 of the adjustment and fixation of the bearing point position of the actuating arm 10, 10'. The cover positioning device 9 comprises a core 9, not described in more detail, which is fixed to one side wall 2 of the furniture 1. Furthermore, the cover positioning device 9 includes an actuating arm 10, 10' which is pivotably connected via a coupling piece 28 with the bearing part 27 of the fixing device 26. The fixing device 26 is arranged on the back of the lower partial flap 6' and includes the actuation member 25 in the form of a movable lever, which, when actuated, effects a clamping of the bearing part 27.

Figures 17A, 17B, 17C, 17D, 17E:
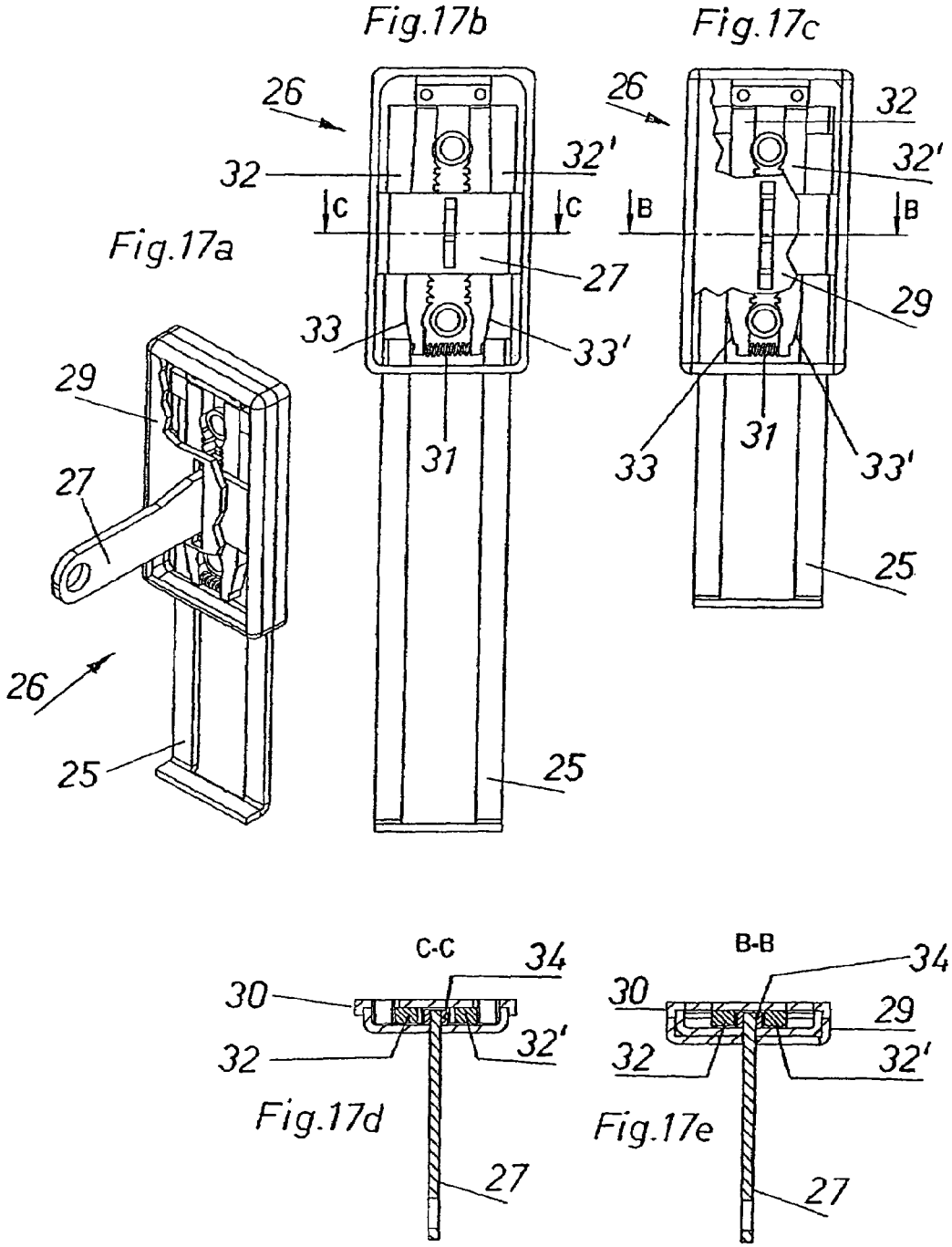
FIGS. 17*a*-17*e* The fixing device for adjusting and fixing the bearing point position in various views.

FIGS. 17*a* to 17*e* show various views of the fixing device 26 for the adjustment and fixation of the bearing point position of the actuating arm 10, 10' connected to the movable furniture part 5. FIG. 17*a* shows a perspectival view of the fixing device 26, FIG. 17*b* the fixing device 26 without cover frame 29 in untensioned condition, FIG. 17*c* the fixing device 26 with partly dismantled cover frame 29 in tensioned condition, while FIG. 17*d* is a sectional view along the axis C-C from FIG. 17*b* of the fixing device 26 in untensioned condition and FIG. 17*e* is a sectional view along the axis B-B from FIG. 17*c* in tensioned condition.

FIG. 17*a* shows the perspectival view of the fixing device 26 in which the bearing part 27 is supported so as to be vertically adjustable. The adjustment path here is preferably limited to a small area, as only small tolerances are equalised. A cutaway view of the fixing device 26 from the front is shown in FIG. 17*b*. The bearing part 27 has a vertical bar 34—not shown in this figure—which is housed between two clamping jaws 32, 32' which are arranged parallel to each other in a clamping mechanism. The position of the bearing part 27 is fixable by the clamping mechanism, where the actuation member 25 is in direct contact with the two clamping jaws 32, 32'. The two toothed clamping jaws 32, 32' are acted on by the force of a spring element 31 so that they are forced outwards, as the result of which the vertical bar 34 of the bearing part 27 is not clamped. The bearing part 27 can thus be movably retained in the position shown in FIG. 17 within a partial area of the toothed clamping jaws 32, 32'. The toothed clamping jaws 32, 32' have slanted areas 33, 33' in their lower area. When the actuation member 25 is moved upwards, pressure is exerted against the force of the spring element 31 via the arranged slanted areas 33, 33', as the result of which these two toothed clamping jaws 32, 32' are pressed together to clamp the vertical bar 34 in between. This tensioned position is visible from FIG. 17*c*. FIG. 17*d* shows a top view along the axis C-C from FIG. 17*d*, where the toothed clamping jaws 32, 32' are somewhat distanced from the vertical bar 34. FIG. 17*e* shows a top view along the axis B-B from FIG. 17*c*, where the toothed clamping jaws 32, 32' abut on the vertical bar 34, thereby clamping it.

Figure 18A:
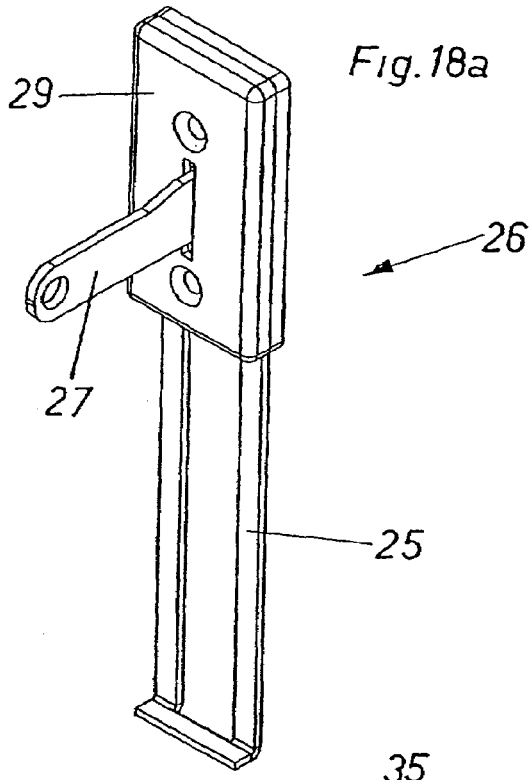
FIGS. 18*a*, 18*b* A view of the fixing device in a perspectival view and also in an exploded view.
Figure 18B:
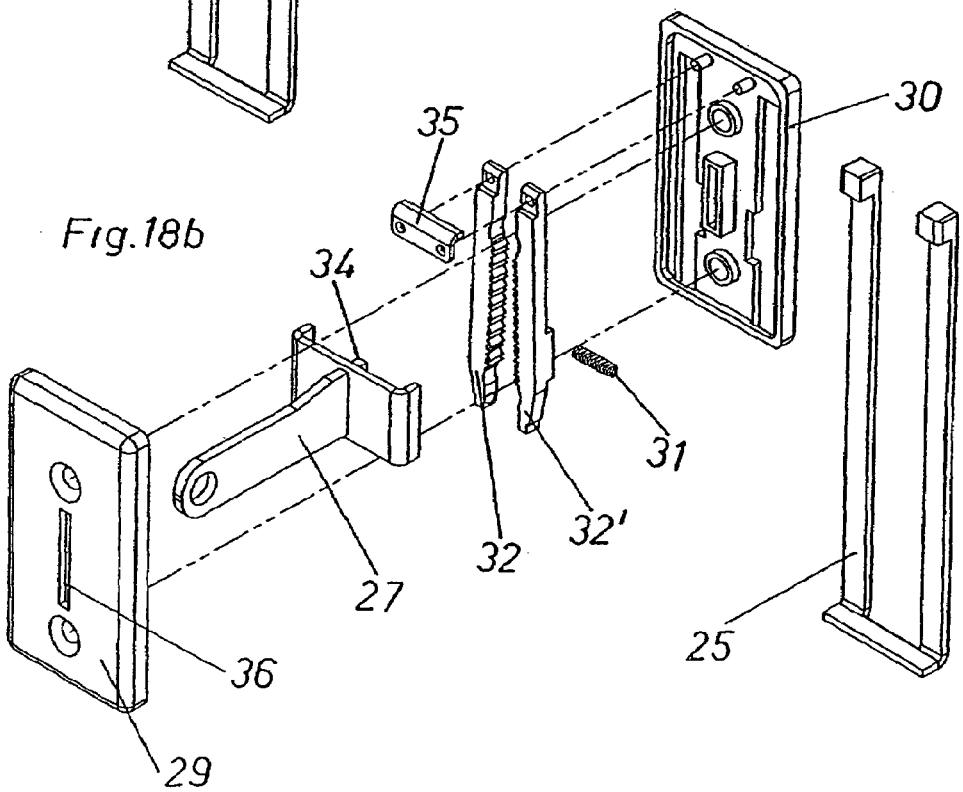

FIG. 18*a* shows the fixing device 26 with the bearing part 27 which can be fixed by the actuation member 25 in a perspectival view. FIG. 18*b* shows an exploded view of the fixing device 26 with the cover frame 29, which has a vertical slot 36. In the assembled condition, the bearing part 27 projects through this slot 36. On the back side of the bearing part 27 is provided a vertical bar 34, which can be clamped by the toothed clamping jaws 32, 32'. In the upper area, the clamping jaws 32, 32' are held together by a connection part 35 and screwed onto the fixing frame 30, so that the actuation member 25, which can be actuated when the furniture flap 5 is closed, can fix the bearing part 27 in its position.

The invention is not limited to the embodiments shown, but includes or extends to all technical equivalents which may fall within the scope of the following claims. The positional details which are selected in the description, such as for example above, under, lateral, etc. relate to the usual installation position or to the directly described and illustrated figure and, if there is any change in position, should be transferred logically to the new position. The use of the inventive retaining and adjustment device is not limited solely to use with folding flaps 5, but in principle encompasses all—including one-piece—furniture flaps 5 which are moved by an actuating arm 10, 10'. In the process for adjustment of the length-adjustable actuating arm 10, 10', this is preferably in a retracted condition in the original position. The process can, however, also be executed such that the adjustment lever arm 10, 10' is brought from an extended position into a retracted position.

The invention claimed is:

1. A retaining and adjustment device coupled to a movable furniture part, comprising:

an actuating arm for moving said movable furniture part;

said actuating arm being coupled to said movable furniture part;

said actuating arm being length-adjustable;

wherein a length of said actuating arm can be adjusted when said movable furniture part is in a closed position;

wherein the length of said actuating arm is finally fixable by a stop device;

wherein said stop device comprises a tension lever;

wherein said stop device comprises an adjusting rod which is movable by said tension lever; and wherein said stop device includes a wedge-shaped tension part which is movable by said adjusting rod, whereby a clamping part can be pressed by said tension part onto an inner wall of said actuating arm.

2. A retaining and adjustment device coupled to a movable furniture part, comprising:

an actuating arm for moving said movable furniture part;

said actuating arm being coupled to said movable furniture part;

said actuating arm being length-adjustable;

wherein a bearing point position of said actuating arm can be adjusted when said movable furniture part is in a closed position; and wherein said bearing point position of said actuating arm can be fixed by a fixing device arranged on said movable furniture part, whereby an actuation member of said fixing device can be actuated from outside when said movable furniture part is in the closed position.

3. The retaining and adjustment device according to claim 2, wherein said fixing device has a movable bearing part, the position of which can be fixed by said actuation member.

4. The retaining and adjustment device according to claim 3, wherein the position of said bearing part can be fixed by a spring-loaded clamping mechanism, whereby said actuation member is in direct contact with said clamping mechanism.

5. A retaining and adjusting device for use in movably coupling a movable furniture part to a fixed furniture part, comprising:

a first fixing device configured to be fixed to one of the fixed furniture part and the movable furniture part;

a second fixing device configured to be fixed to the other of the fixed furniture part and the movable furniture part;

an actuating arm coupled between said first fixing device and said second fixing device, said actuating arm including a first actuating arm part;

wherein said actuating arm is movable, relative to the one of said first and second fixing devices that is configured to be fixed to the fixed furniture part, between a movable furniture part open position and a movable furniture part closed position;

wherein said first actuating arm part has a first end part pivotably connected to said first fixing device at a first pivot point;

wherein a second end part of said first actuating arm part is coupled to said second fixing device via a length-adjusting mechanism;

wherein said length-adjusting mechanism is configured to adjust a length between said first pivot point and a location at which said second end part of said first actuating arm part is coupled to said second fixing device;

wherein said length-adjusting mechanism is further configured to be changed from a pre-fixing condition, in which said length-adjusting mechanism tentatively maintains said length between said first pivot point and the location at which said second end part of said first actuating arm part is coupled to said second fixing device, and a final-fixing condition in which said length-adjusting mechanism positively fixes said length between said first pivot point and the location at which said second end part of said first actuating arm part is coupled to said second fixing device; and wherein said length-adjusting mechanism is configured and arranged so as to be placed in said pre-fixing condition when said actuating arm is positioned in said movable furniture part closed position.

6. The retaining and adjusting device according to claim 5, wherein said length-adjusting mechanism includes an operator-manipulable member movable between a first position in which said length-adjusting mechanism is in said pre-fixing condition and a second position in which said length-adjusting mechanism is in said final-fixing condition.

7. The retaining and adjusting device according to claim 6, wherein said operator-manipulable part comprises a pivotable lever.

8. The retaining and adjusting device according to claim 6, wherein said operator-manipulable part comprises a slidable actuation member.

9. The retaining and adjusting device according to claim 6, wherein said length-adjusting mechanism includes first and second elements respectively coupled to said first and second fixing devices, said second element being slidably mounted for movement relative to said first element, and a clamping part movable between a clamping position, in which said clamping part clamps said first and second elements together to prevent relative sliding thereof, and a non-clamping position, wherein said clamping part is operably coupled to said operator-manipulable member such that, when said operator-manipulable member is moved to said second position, said clamping part is moved to said clamping position.

10. The retaining and adjusting device according to claim 9, wherein said operator-manipulable part comprises a pivotable lever.

11. The retaining and adjusting device according to claim 9, wherein said operator-manipulable part comprises a slidable actuation member.

12. The retaining and adjusting device according to claim 5, wherein said actuating arm further includes a second actuating arm part, said first and second actuating arm parts being slidably mounted to each other.

13. The retaining and adjusting device according to claim 12, wherein said length-adjusting mechanism is configured to adjust the length, between said first pivot point and the location at which said second end part of said first actuating arm part is coupled to said second fixing device, by adjusting a length of the actuator arm by slidably adjusting said first and second actuator arm parts relative to one another.

14. The retaining and adjusting device according to claim 13, wherein said length-adjusting mechanism causes said first and second actuating arm parts to be frictionally connected to each other such that, upon stopping of sliding relative to each other, said first and second actuating arm parts attain a condition in which said first and second actuating end parts are tentatively frictionally held against sliding relative to each other due to frictional engagement.

15. The retaining and adjusting device according to claim 14, wherein said length-adjusting mechanism comprises a spring-loaded pressure part which presses against an inner wall of said actuator arm to create the frictional engagement.

16. The retaining and adjusting device according to claim 5, further comprising a bearing part slidably mounted to said second fixing device;

wherein said actuating arm is pivotably coupled to said bearing part at a second pivot point.

17. The retaining and adjusting device according to claim 16, wherein said length-adjusting mechanism is interposed between said bearing device and said second fixing device for adjusting a position of said bearing part relative to said second fixing device.

18. The retaining and adjusting device according to claim 17, wherein said length-adjusting mechanism comprises clamping jaws that are configured to clamp about a portion of said second fixing device.

19. The retaining and adjusting device according to claim 18, wherein said length-adjusting mechanism further comprises an operator-manipulable sliding actuation member; and in said final-fixing condition of said length-adjusting mechanism, said sliding actuation member is positioned so as to press said clamping jaws toward each other and into clamping engagement about said portion of said second fixing device.

20. A piece of furniture with a furniture body and a folding flap, said folding flap comprises a first partial flap which is pivotally connected about a horizontally disposed first axis on said furniture body and a second partial flap, which is pivotably connected about a horizontally disposed second axis with said first partial flap, wherein at least one retaining and adjustment device according to claim 5 is provided to support said folding flap relative to said furniture body.

21. A method for retaining and adjusting a movable furniture part relative to a fixed furniture part having the movable furniture part pivotally mounted to the fixed furniture part for movement between a closed position closing an open part of the fixed furniture part and an open position, said method comprising:

providing said retaining and adjusting device according to claim 5;

fixing said one of said first and second fixing devices to said fixed furniture part;

fixing said other of said first and second fixing devices to said movable furniture part;

moving the movable furniture part to the closed position so as to cause said length-adjusting mechanism to adjust, to a desired length, said length between said first pivot point and the location at which said second end part of said first actuating arm part is coupled to said second fixing device, and such that said length-adjusting mechanism is placed in said pre-fixing condition in which said length-adjusting mechanism tentatively maintains said length between said first pivot point and a location at which said second end part of said first actuating arm part is coupled to said second fixing device;

after said length-adjusting mechanism has been placed in said pre-fixing condition, placing said length-adjusting mechanism in said final-fixing condition in which said length-adjusting mechanism positively fixes said length between said first pivot point and the location at which said second end part of said first actuating arm part is coupled to said second fixing device.

22. The method according to claim 21, further comprising after said length-adjusting mechanism has been placed in said pre-fixing condition, moving the movable furniture part to the open position while said length-adjusting mechanism maintains, at said desired length, said length between said first pivot point and the location at which said second end part of said first actuating arm part is coupled to said second fixing device;

wherein said placing of said length-adjusting mechanism in said final-fixing condition is performed after said moving of said movable furniture part to said open position.

23. The method according to claim 22, wherein in said moving of said movable furniture part to the closed position, said length-adjusting mechanism adjusts said length, between said first pivot point and the location at which said second end part of said first actuating arm part is coupled to said second fixing device, by adjusting a length of said actuating arm.

24. The method according to claim 21, wherein said providing of said retaining and adjusting device comprises providing said retaining and adjusting device so as to further include a bearing part slidably mounted to said second fixing device, and wherein said actuating arm is pivotably coupled to said bearing part at a second pivot point; and in said moving of the movable furniture part to the closed position, said length-adjusting mechanism adjusts said length, between said first pivot point and the location at which said second end part of said first actuating arm part is coupled to said second fixing device, by adjusting a location of said bearing part relative to said second fixing device.

* * * * *